US009277769B2

(12) United States Patent
Liu

(10) Patent No.: US 9,277,769 B2
(45) Date of Patent: Mar. 8, 2016

(54) ELECTRIC-CIGARETTE

(75) Inventor: Qiuming Liu, Guangdong (CN)

(73) Assignee: HUIZHOU KIMREE TECHNOLOGY CO., LTD., Shenzhen (CN)

( * ) Notice: Subject to any disclaimer, the term of this patent is extended or adjusted under 35 U.S.C. 154(b) by 696 days.

(21) Appl. No.: 13/511,583

(22) PCT Filed: Apr. 13, 2010

(86) PCT No.: PCT/CN2010/071712

§ 371 (c)(1),
(2), (4) Date: May 23, 2012

(87) PCT Pub. No.: WO2011/127644

PCT Pub. Date: Oct. 20, 2011

(65) Prior Publication Data

US 2013/0019887 A1 Jan. 24, 2013

(51) Int. Cl.
*A24F 47/00* (2006.01)

(52) U.S. Cl.
CPC ..... *A24F 47/008* (2013.01)

(58) Field of Classification Search
CPC . A24F 47/008; A61M 11/042; A61M 15/001; A61M 15/0068; A61M 15/0071; A61M 15/06
See application file for complete search history.

(56) References Cited

U.S. PATENT DOCUMENTS 5,060,671 A * 10/1991 Counts ..... A24F 47/008 128/202.21
5,095,921 A * 3/1992 Losee ..... A24F 47/008 128/200.19
5,144,962 A * 9/1992 Counts ..... A24F 47/008 128/200.14
5,179,966 A * 1/1993 Losee ..... A24F 47/008 128/202.21
5,249,586 A * 10/1993 Morgan ..... A24F 47/008 128/200.14
5,261,424 A * 11/1993 Sprinkel, Jr. ..... A24F 47/008 128/202.21
5,269,327 A * 12/1993 Counts ..... A24F 47/008 128/200.14
5,505,214 A * 4/1996 Collins ..... A24F 47/008 128/202.21
5,666,977 A * 9/1997 Higgins ..... A24F 47/008 128/200.14
5,894,841 A * 4/1999 Voges ..... A24F 47/008 128/200.14
6,196,218 B1 * 3/2001 Voges ..... A24F 47/002 128/200.14
6,854,470 B1 * 2/2005 Pu ..... A61M 15/06 128/202.21
2006/0016453 A1 * 1/2006 Kim ..... A24F 47/008 131/194
2007/0074734 A1 * 4/2007 Braunshteyn ..... A24F 13/00 131/328
2008/0023003 A1 * 1/2008 Rosenthal ..... A61M 11/041 128/203.26
2009/0302019 A1 * 12/2009 Selenski ..... A24F 47/008 219/201
2010/0031968 A1 * 2/2010 Sheikh ..... A24F 47/008 131/347

(Continued)

FOREIGN PATENT DOCUMENTS

CN 201088138 Y 7/2008
CN 201219484 Y 4/2009

(Continued)

*Primary Examiner* — Jason L Lazorcik
(74) *Attorney, Agent, or Firm* — Locke Lord LLP; Tim Tingkang Xia, Esq.

(57) ABSTRACT

An electric-cigarette comprises a heating element and a battery electrically connected to the heating element. The cigarette further comprises an annular, semi-annular or arc illuminant arranged on the housing between the butt and the mouth of the electric-cigarette, the illuminant electrically connects to the battery.

3 Claims, 4 Drawing Sheets

(56) References Cited

U.S. PATENT DOCUMENTS

2010/0200008 A1* 8/2010 Taieb ..... A24F 47/008 131/360
2011/0036346 A1* 2/2011 Cohen ..... A61M 15/0065 128/200.14
2011/0277756 A1* 11/2011 Terry ..... A61M 15/06 128/202.21
2011/0277757 A1* 11/2011 Terry ..... A24F 47/008 128/202.21
2011/0277761 A1* 11/2011 Terry ..... A24F 47/008 128/203.12
2011/0278189 A1* 11/2011 Terry ..... A24F 47/008 206/459.1
2011/0290248 A1* 12/2011 Schennum ..... A24F 47/002 128/202.21

FOREIGN PATENT DOCUMENTS

CN 201352950 Y 12/2009
WO 2007078273 A1 7/2007

* cited by examiner

ELECTRIC-CIGARETTE

FIELD OF THE INVENTION

The present invention relates to a cigarette and an electric-cigarette, specially, to an electric-cigarette with visual impact to people.

BACKGROUND OF THE UTILITY MODEL

Electric-cigarette is a simulation cigarette electronic product comprising a battery, a switch, a heating element for atomizing tobacco tar which allows to achieve an effect of smoking, and an luminescent lamp for simulating flame. For now, the shape of electric-cigarettes on the market is mainly divided into cigarette, cigar and pipe. Based on the control mode of electric-cigarettes, they are divided into two types: touch-tone one and air-switch one. The touch-tone switch is commonly implemented for those electric-cigarettes with a shape of cigarette and cigar, including for those ones that are reusable or disposable. The outline structure of such electric-cigarette is illustrated in FIG. 1-1, FIG. 1-2 and FIG. 1-3, which comprises a cigarette body equipped with a button 12, a cartridge, an opaque metallic or plastic ring 11 arranged in the joint of the cigarette body and the cartridge as well as a luminescent lamp 15 and a light guide cap 16 arranged at the butt of the cigarette body. The inside of the electric-cigarette is equipped with a switch 13 corresponding to the button 12 and a battery 14 electrically connected to the switch. The luminescent lamp 15 is electrically connected to the switch 13 and the battery 14. The button 12 is configured to control the working hours of the electric-cigarette.

The air-switch is commonly implemented for electric-cigarettes with a shape of cigarette, cigar and pipe, including for those ones that are reusable or disposable. The outline structure of such electric-cigarette is illustrated in FIG. 2-1 and FIG. 2-2, of which a luminescent lamp 15 and a light guide cap 16 connected with a battery are also arranged at the butt of the cigarette body. During smoking, the air-switch in the cigarette body is enabled so that the electric-cigarette begins to work normally.

These luminescent lamps in the electric-cigarette are only for simulating the flame of the butt, and limited to be approximate to traditional cigarettes for visual appearance, thus being stagnated in design and insufficient to provide fresher and more beautiful visual impact so as to meet higher request of people.

DISCLOSURE OF THE INVENTION

Technical Problem

The object of the invention is to provide an electric-cigarette, aiming at overcoming the disadvantages of the above mentioned prior art and providing users with better visual experience on the basis of enjoying non-toxic electric-cigarette.

Technical Solution

The object of the invention can be achieved through measures as described below:

The electric-cigarette comprises a heating element and a battery electrically connected to the heating element. The electric-cigarette further comprises an annular, semi-annular or arc illuminant arranged on the housing between the butt and the mouth of the electric-cigarette, and the illuminant electrically connects to the battery.

The object of the invention can also be achieved through measures as described below:

There is one or more than one illuminant.

The more than one illuminant is of the same shape in all, partial or none part.

The illuminant connects to the battery through a switch or an electronic switch.

The switch or the electronic switch further connects to the heating element for atomization in the electric-cigarette, which is a traditional way of achieving atomization and illumination simultaneously by one switch.

An illumination control unit connected with a control end of the electronic switch and another switch connected with the heating element for atomization and the battery of the electric-cigarette are also included. The way in which the atomization and illumination are separated can further control the illumination to provide various dynamic visual effects (including but not limited to that the plurality of illuminants illuminate asynchronously, successively or randomly).

The angle between the plane of the annular, semi-annular or arc illuminant and the cross section of the cigarette body of the electric-cigarette is greater than or equal to zero degree, and less than 90 degree. Advantageously, the illuminant is the annular, semi-annular or arc illuminant in radical direction which are arranged in the joint of the cigarette body and the cartridge of the disposable electronic cigarette and in place of traditional metallic or plastic ring. Their radical direction means: the angle between the plane of the annular, semi-annular or arc illuminant and the cross section of the cigarette body of the electric-cigarette is equal to zero degree. For a common electric-cigarette or a disposable cartridge electric-cigarette, since its cigarette body and cartridge are in bolt connection or plug-in connection, it is very difficult to arrange the illuminant in the joint of the cigarette body and the cartridge.

The color of the illuminant is one or more than one of red, yellow, blue, green and purple.

The illuminant comprises a euphotic housing and a luminous element therein.

The electric-cigarette is a common electronic-cigarette, a disposable cartridge electric-cigarette or a disposable electric-cigarette, wherein all of which are reusable.

Advantageous Effect

Compared to the prior art, this invention has the advantages as described below:

A. The addition of luminous part provides the electric-cigarette with a stronger and better visual effect.

B. Traditional design limitation is broken and novel experience for people is satisfied.

BRIEF DESCRIPTION OF THE DRAWINGS

FIGS. 2-1 and 2-2 illustrate the outline structure of traditional electric-cigarette with a shape of pipe;

FIGS. 3 and 4 illustrate the outline structure of a specific embodiment of the present invention;

FIGS. 5-1 and 5-2 illustrate the outline structure of another specific embodiment of the present invention.

THE PREFERRED EMBODIMENTS OF THE INVENTION

Figure 1:
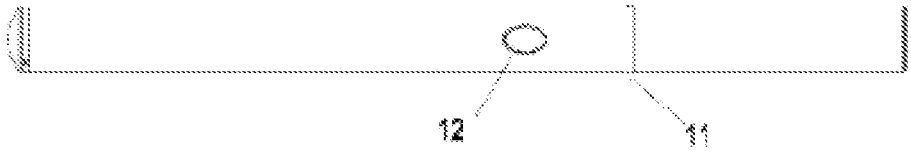
FIGS. 1-1, 1-2 and 1-3 illustrate the outline structure of traditional electric-cigarette with a shape of cigarette.
Figures 1, 2:
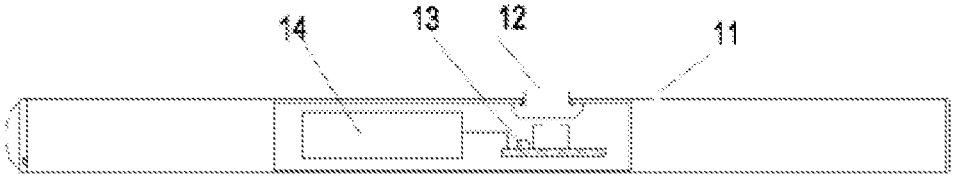
Figures 1, 2, 3:
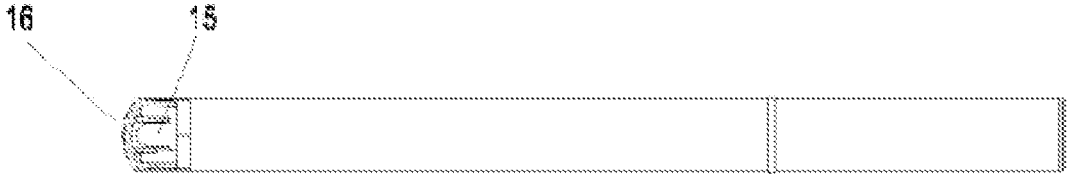
Figures 1, 2:
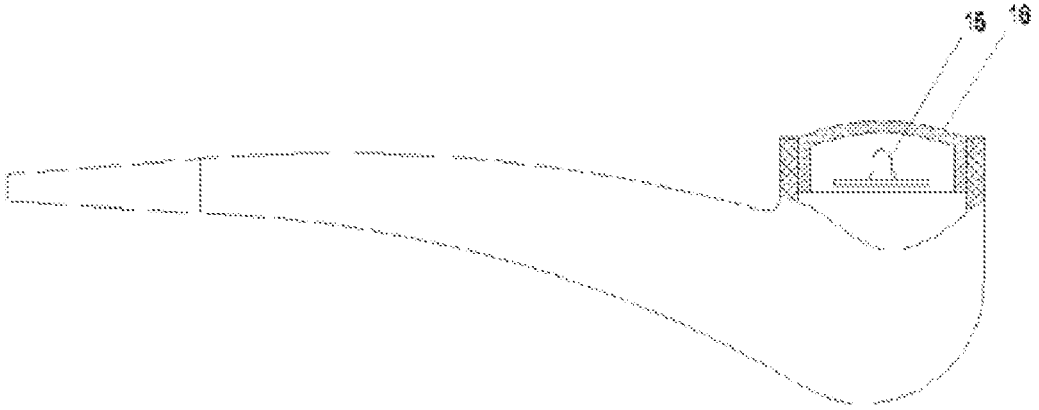
Figure 2:
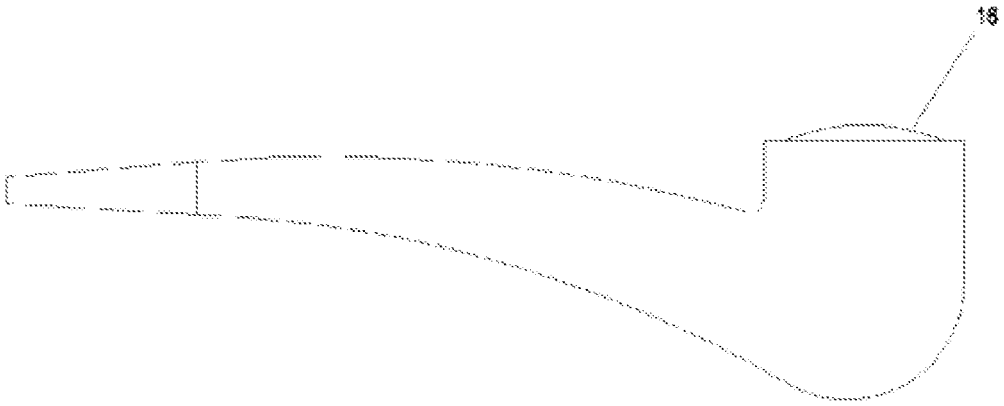
Figure 3:
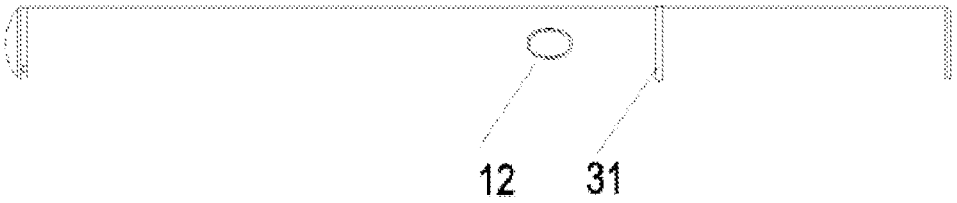
Figure 4:
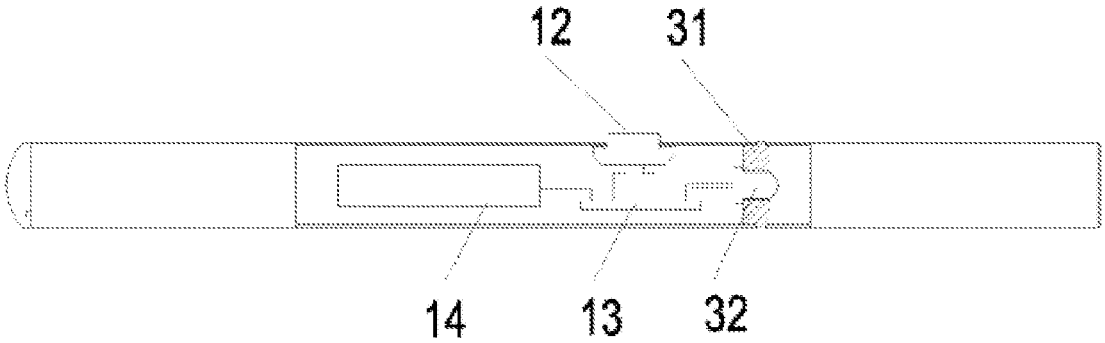

The best embodiment of the present invention is specially implemented in a disposable electric-cigarette with its structure illustrated in FIGS. 3 and 4. In appearance, the electric-cigarette comprises a button 12 and a circular euphotic housing 31 as the substitute of metallic or plastic ring 11. The inside of the electric-cigarette comprises a luminous element 32 in the center of the euphotic housing 31, a switch 13 corresponding to the button 12 and a battery 14, wherein they are electrically connected into a loop. Meanwhile, the switch 13 also controls a heating element for atomization in the electric-cigarette, that is to say, the luminous element 32 is lighting when the electric-cigarette is used for smoking.

MODE FOR INVENTION

Figures 1, 5:
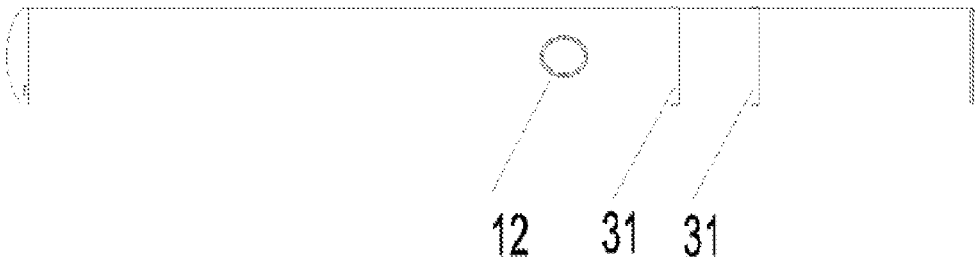
Figures 2, 5:
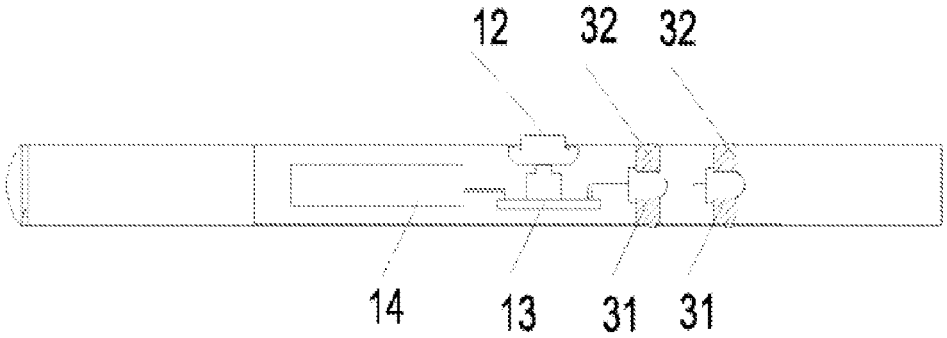

Another embodiment of the present invention is specially implemented in a disposable electric-cigarette with its structure illustrated in FIGS. 5-1 and 5-2. In appearance, the electric-cigarette comprises a button 12 and two circular euphotic housings 31. The inside of the electric-cigarette comprises two luminous elements 32 in the center of the two circular euphotic housings 31, a switch 13 corresponding to the button 12 and a battery 14, wherein they are electrically connected into a loop. The switch 13 also controls a heating element for atomization in the electric-cigarette, that is to say, the luminous element 32 is lighting when the electric-cigarette is used for smoking.

INDUSTRIAL APPLICABILITY

The atomization device of the present invention is applicable to various types of electric-cigarettes, particularly to the disposable electric-cigarette. It can provide people with more beautiful and updated visual experience than that of the traditional cigarette. In this way, the electric-cigarette of the invention can be better accepted by smokers and consequently make more smokers suffered from the traditional cigarette enjoy the pleasure of non-toxic smoking.

The invention claimed is:

1. An electric-cigarette, comprising a hollow tube;

a mouthpiece coupled to one end of the hollow tube;

a light-guide cap with a luminescent lamp arranged therein, which is coupled to the other end of the hollow tube;

two light transmissible rings arranged on the hollow tube between the mouthpiece and the light-guide cap, which are closer to the mouthpiece than to the light-guide cap;

two luminous elements arranged in the two light transmissible rings respectively;

a button arranged on the hollow tube;

a switch corresponding to the button, which is arranged in the hollow tube;

a heating element arranged in the hollow tube, and a battery electrically connected to the heating element, the luminescent lamp, and the two luminous elements respectively via the switch;

wherein, the two light transmissible rings are spaced on the hollow tube along a longitudinal axis of the hollow tube, the switch is configured to connect the heating element, the luminescent lamp and the two luminous elements with the battery so that the luminescent lamp and the two luminous elements are lighted when smoking.

2. The electric-cigarette of claim 1, wherein the electric-cigarette further comprises an illumination control unit connected with a control end of the switch.

3. The electric-cigarette of claim 1, wherein the electric-cigarette is a common reusable electronic-cigarette, a disposable cartridge electric-cigarette or a disposable electric-cigarette.

* * * * *